US012729857B1

(12) United States Patent
Feiz et al.

(10) Patent No.: US 12,729,857 B1
(45) Date of Patent: Sep. 8, 2026

(54) IMMERSED INJECTOR HAVING COMPACT PREMIXING BODIES

(71) Applicant: GE Vernova Infrastructure Technology LLC, Greenville, SC (US)

(72) Inventors: Homayoon Feiz, Greenville, SC (US); Jonathan Dwight Berry, Simpsonville, SC (US); Michael John Hughes, State College, PA (US); Justin Mark Bailey, Greenville, SC (US); Bradley D. Crawley, Greenville, SC (US); Frank A Mignano, Surprise, AZ (US)

(73) Assignee: GE Vernova Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 19/280,665

(22) Filed: Jul. 25, 2025

(51) Int. Cl.
*F23R 3/34* (2006.01)
*F23R 3/28* (2006.01)

(52) U.S. Cl.
CPC ..... *F23R 3/346* (2013.01); *F23R 3/286* (2013.01)

(58) Field of Classification Search
CPC ..... F23R 3/346; F23R 3/286; F02C 7/222; F02C 7/22
See application file for complete search history.

(56) References Cited

U.S. PATENT DOCUMENTS 2,930,192 A 3/1960 Johnson
3,872,664 A 3/1975 Lohmann et al.
4,062,182 A 12/1977 Fehler et al.
4,910,957 A 3/1990 Moreno et al.
4,928,481 A 5/1990 Joshi et al.
5,193,346 A 3/1993 Kuwata et al.
5,749,219 A * 5/1998 DuBell ..... F23R 3/346 60/737
6,047,550 A 4/2000 Beebe
6,192,688 B1 2/2001 Beebe
6,840,049 B2 * 1/2005 Ziegner ..... F02C 6/003 60/737
6,868,676 B1 3/2005 Haynes
(Continued)

FOREIGN PATENT DOCUMENTS

DE 102014103087 A1 * 9/2014 ..... F01D 9/023
EP 0959298 A2 * 11/1999 ..... F23C 7/00
EP 4245977 A1 * 9/2023 ..... F01K 23/106

OTHER PUBLICATIONS

Co-Pending U.S. Appl. No. 17/975,113, filed Oct. 27, 2022.

*Primary Examiner* — Craig Kim
(74) *Attorney, Agent, or Firm* — Dority & Manning, P.A.

(57) ABSTRACT

A fuel injector includes a premix injector that defines one or more premix passages. The premix injector includes a fuel supply portion for providing fuel to the one or more premix passages and defines one or more air apertures for providing air to the one or more premix passages. The fuel injector further includes an immersed injector that is coupled to the premix injector. The immersed injector defines an air chamber and includes an immersed body. The immersed injector further includes a fuel supply conduit that defines a fuel supply passage. The immersed injector further includes a compact premixing body that extends between the fuel supply conduit and the immersed body. The compact premixing body defines one or more compact premixing chambers fluidly connected to the fuel supply passage and the air chamber.

18 Claims, 7 Drawing Sheets

(56) References Cited

U.S. PATENT DOCUMENTS 6,868,678 B2 3/2005 Mei et al.
7,870,736 B2 * 1/2011 Homitz ..... F23D 14/08 60/737
7,886,539 B2 2/2011 Cai
8,479,518 B1 * 7/2013 Chen ..... F23R 3/005 60/733
8,677,753 B2 * 3/2014 Melton ..... F23R 3/346 60/733
8,752,386 B2 * 6/2014 Fox ..... F23R 3/286 60/737
8,769,955 B2 * 7/2014 Van Nieuwenhuizen ..... F23R 3/286 60/737
9,052,115 B2 * 6/2015 Stoia ..... F23R 3/346
9,151,500 B2 * 10/2015 Chen ..... F23R 3/286
9,200,808 B2 * 12/2015 Romig ..... F23R 3/28
9,228,499 B2 1/2016 Stryapunin
9,291,098 B2 3/2016 Chen et al.
9,388,987 B2 * 7/2016 Valeev ..... F23R 3/045
9,631,815 B2 * 4/2017 Antoniono ..... F23R 3/286
9,903,588 B2 * 2/2018 Slobodyanskiy ..... F23N 1/02
10,222,066 B2 * 3/2019 Chen ..... F23R 3/34
10,513,987 B2 * 12/2019 Hughes ..... F23R 3/34
10,788,212 B2 * 9/2020 Allen ..... F23R 3/045
10,816,203 B2 * 10/2020 Jones ..... F23R 3/06
11,067,281 B1 7/2021 Garcia et al.
11,137,144 B2 * 10/2021 Wilson ..... F23R 3/346
11,187,415 B2 * 11/2021 Jones ..... F23R 3/002
11,248,794 B2 * 2/2022 Berry ..... F02C 7/22
11,255,545 B1 * 2/2022 Berry ..... F23R 3/283
11,371,710 B2 6/2022 Bulat
11,566,790 B1 * 1/2023 Hughes ..... F23R 3/20
11,828,467 B2 * 11/2023 Berry ..... B01F 25/314231
11,846,426 B2 * 12/2023 Giridharan ..... F02C 3/30
12,025,314 B2 7/2024 Hughes et al.
12,092,061 B1 * 9/2024 DiCintio ..... F02M 55/001
12,188,658 B1 * 1/2025 Berry ..... F23R 3/286
12,196,422 B2 * 1/2025 Singh ..... F23R 3/346
12,203,659 B2 * 1/2025 Myers ..... F23R 3/346
12,429,223 B2 * 9/2025 Miranda ..... F02C 7/228
12,449,128 B1 * 10/2025 Yepes ..... F23R 3/002
2007/0271927 A1 11/2007 Myers et al.
2007/0277528 A1 12/2007 Homitz et al.
2008/0264033 A1 10/2008 Lacy et al.
2009/0084082 A1 4/2009 Martin et al.
2010/0034643 A1 2/2010 Davis, Jr. et al.
2010/0071376 A1 3/2010 Wiebe et al.
2010/0170219 A1 7/2010 Venkataraman et al.
2010/0170252 A1 7/2010 Venkataraman et al.
2010/0174466 A1 7/2010 Davis, Jr. et al.
2010/0229557 A1 9/2010 Matsumoto et al.
2010/0242482 A1 9/2010 Kraemer et al.
2011/0067402 A1 3/2011 Wiebe et al.
2011/0179803 A1 7/2011 Berry et al.
2011/0185735 A1 8/2011 Snyder
2011/0289928 A1 * 12/2011 Fox ..... F23R 3/34 60/740
2011/0296839 A1 12/2011 Van Nieuwenhuizen et al.
2013/0067921 A1 3/2013 Hadley et al.
2013/0174558 A1 7/2013 Stryapunin
2013/0234396 A1 9/2013 Willis et al.
2014/0260269 A1 9/2014 Davis, Jr. et al.
2015/0275755 A1 10/2015 Ogata et al.
2015/0276226 A1 10/2015 Laster et al.
2015/0285501 A1 10/2015 DiCintio et al.
2015/0285504 A1 10/2015 Melton
2016/0258629 A1 9/2016 Slobodyanskiy et al.
2017/0176014 A1 6/2017 Hughes et al.
2017/0268784 A1 * 9/2017 Crawley ..... F23R 3/34
2017/0268786 A1 * 9/2017 Cai ..... F23R 3/283
2017/0307210 A1 10/2017 Hirano et al.
2017/0321609 A1 * 11/2017 Ogata ..... F02C 7/228
2017/0356656 A1 * 12/2017 Ogata ..... F23R 3/28
2018/0087390 A1 3/2018 Morgan et al.
2018/0187607 A1 * 7/2018 Hughes ..... F02C 7/222
2018/0187893 A1 7/2018 DiCintio et al.
2018/0328587 A1 * 11/2018 Gubba ..... F23R 3/346
2018/0328588 A1 * 11/2018 Lemon ..... F23R 3/36
2021/0199299 A1 * 7/2021 Berry ..... B01F 25/311
2022/0026069 A1 1/2022 Paniharam et al.
2022/0412563 A1 12/2022 Giridharan et al.

* cited by examiner

IMMERSED INJECTOR HAVING COMPACT PREMIXING BODIES

FEDERALLY SPONSORED RESEARCH

This invention was made with government support under contract number DE-FE0032173 awarded by the Department of Energy. The U.S. government may have certain rights in the invention.

FIELD

The present disclosure relates generally to a fuel injector for a gas turbine combustor and, more particularly, to a fuel injector for use with an axial fuel staging (AFS) system associated with such combustors.

BACKGROUND

Turbomachines are utilized in a variety of industries and applications for energy transfer purposes. For example, a gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine engine via the exhaust section.

In some combustors, the generation of combustion gases occurs at two or more axially spaced stages. Such combustors are referred to herein as including an "axial fuel staging" (AFS) system, which delivers fuel and an oxidant to one or more fuel injectors downstream of the head end of the combustor. In a combustor with an AFS system, a primary fuel nozzle at an upstream end of the combustor injects fuel and air (or a fuel/air mixture) in an axial direction into a primary combustion zone, and an AFS fuel injector located at a position downstream of the primary fuel nozzle injects fuel and air (or a second fuel/air mixture) as a cross-flow into a secondary combustion zone downstream of the primary combustion zone. The cross-flow is generally transverse to the flow of combustion products from the primary combustion zone.

Traditional gas turbine engines include one or more combustors that burn a mixture of natural gas and air within the combustion chamber to generate the high pressure and temperature combustion gases. As a byproduct, oxides of nitrogen (NOx), carbon dioxide ($CO_2$), and other pollutants are created and expelled by the exhaust section. Regulatory requirements for low emissions from gas turbines are continually growing more stringent, and environmental agencies throughout the world are now requiring even lower rates of emissions of NOx and other pollutants from both new and existing gas turbines.

Burning a blend of natural gas and high amounts of hydrogen and/or burning pure hydrogen instead of natural gas within the combustor would significantly reduce or eliminate the emission of $CO_2$. However, because hydrogen burning characteristics are different than those of natural gas, traditional combustion systems, including traditional AFS fuel injectors, are not capable of burning high levels of hydrogen and/or pure hydrogen without issue. For example, burning high levels of hydrogen and/or pure hydrogen within a traditional combustion system could promote flashback or flame holding conditions in which the combustion flame migrates towards the fuel being supplied by the injector, possibly causing severe damage to the injector in a relatively short amount of time.

As such, a fuel injector capable of delivering alternative fuels (such as hydrogen) and air to a secondary combustion zone, without causing flame holding or flashback issues, is desired in the art.

BRIEF DESCRIPTION

Aspects and advantages of the fuel injectors and combustors in accordance with the present disclosure will be set forth in part in the following description, or may be obvious from the description, or may be learned through practice of the technology.

In accordance with one embodiment, a fuel injector is provided. The fuel injector defines a mutually orthogonal coordinate system that includes a vertical direction, a longitudinal direction, and a transverse direction. The fuel injector includes a premix injector that defines one or more premix passages. The premix injector includes a fuel supply portion for providing fuel to the one or more premix passages and defines one or more air apertures for providing air to the one or more premix passages. The fuel injector further includes an immersed injector that an air chamber and includes an immersed body. The immersed injector further includes a fuel supply conduit that defines a fuel supply passage. The immersed injector further includes a compact premixing body that extends between the fuel supply conduit and the immersed body. The compact premixing body defines one or more compact premixing chambers fluidly connected to the fuel supply passage and the air chamber.

In accordance with another embodiment, a combustor is provided. The combustor includes a combustion liner that defines a combustion chamber. The combustor further includes a fuel injector that defines a mutually orthogonal coordinate system that includes a vertical direction, a longitudinal direction, and a transverse direction. The fuel injector includes a premix injector that defines one or more premix passages. The premix injector includes a fuel supply portion for providing fuel to the one or more premix passages and defines one or more air apertures for providing air to the one or more premix passages. The fuel injector further includes an immersed injector that defines an air chamber and includes an immersed body. The immersed injector further includes a fuel supply conduit that defines a fuel supply passage. The immersed injector further includes a compact premixing body that extends between the fuel supply conduit and the immersed body. The compact premixing body defines one or more compact premixing chambers fluidly connected to the fuel supply passage, the air chamber, and the combustion chamber.

In accordance with another embodiment, immersed injector is provided. The immersed injector defines an air chamber and includes an immersed body. The immersed injector further includes a fuel supply conduit that defines a fuel supply passage. The immersed injector further includes a compact premixing body that extends between the fuel supply conduit and the immersed body. The compact premixing body defines one or more compact premixing chambers fluidly connected to the fuel supply passage and the air chamber.

These and other features, aspects and advantages of the present fuel injectors and combustors will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present fuel injectors and combustors, including the best mode of making and using the present systems and methods, directed to one of ordinary skill in the art, is set forth in the specification, which makes reference to the appended figures, in which.

DETAILED DESCRIPTION

Figure 1:
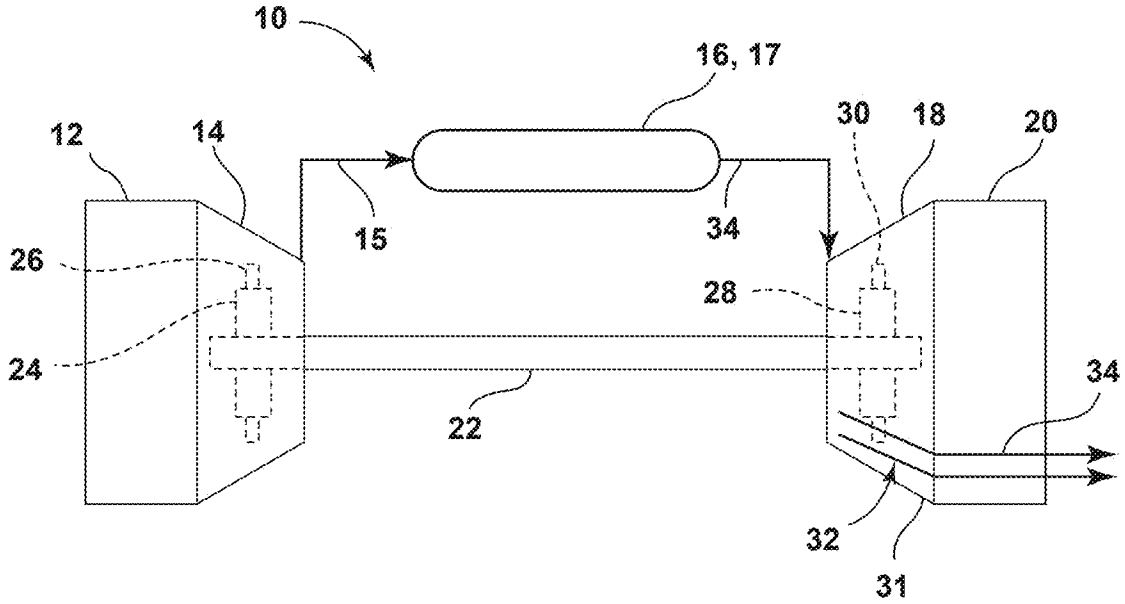
FIG. 1 is a schematic illustration of a turbomachine, in accordance with embodiments of the present disclosure.

Reference now will be made in detail to embodiments of the present fuel injectors and combustors, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The detailed description uses numerical and letter designations to refer to features in the drawings. Like or similar designations in the drawings and description have been used to refer to like or similar parts of the subject technology. As used herein, the terms "first", "second", and "third" may be used interchangeably to distinguish one component from another and are not intended to signify location or importance of the individual components.

The term "fluid" may refer to a gas or a liquid. The term "fluid communication" means that a fluid is capable of flowing or being conveyed between the areas specified.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular component.

Terms of approximation, such as "about," "approximately," "generally," and "substantially," are not to be limited to the precise value specified. In at least some instances, the approximating language may correspond to the precision of an instrument for measuring the value or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. When used in the context of an angle or direction, such terms include within ten degrees greater or less than the stated angle or direction. For example, "generally vertical" includes directions within ten degrees of vertical in any direction, e.g., clockwise or counter-clockwise.

The terms "coupled," "fixed," "attached to," and the like refer to both direct coupling, fixing, or attaching, as well as indirect coupling, fixing, or attaching through one or more intermediate components or features, unless otherwise specified herein. The terms "directly coupled," "directly fixed," "directly attached to," and the like indicate that a first component is joined to a second component with no intervening structures. As used herein, the terms "comprises," "comprising," "includes," "including," "has," "having" or any other variations thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "and/or" refers to a condition satisfied by any one of the following: A is true (or present) and B is false (or not present); A is false (or not present) and B is true (or present); and both A and B are true (or present).

Here and throughout the specification and claims, range limitations are identified and include all the sub-ranges contained therein unless context or language indicates otherwise. For example, all ranges disclosed herein are inclusive of the endpoints, and the endpoints are independently combinable with each other.

Referring now to the drawings, FIG. 1 illustrates a schematic diagram of one embodiment of a turbomachine, which in the illustrated embodiment is a gas turbine 10. Although an industrial or land-based gas turbine is shown and described herein, the present disclosure is not limited to an industrial and/or land-based gas turbine unless otherwise specified in the claims. For example, the technology as described herein may be used in any type of turbomachine including but not limited to a steam turbine, an aircraft gas turbine, or a marine gas turbine.

As shown, gas turbine 10 generally includes an inlet section 12, a compressor section 14 disposed downstream of the inlet section 12, a plurality of combustors 17 (FIG. 2) within a combustion section 16 disposed downstream of the compressor section 14, a turbine section 18 disposed downstream of the combustion section 16, and an exhaust section 20 disposed downstream of the turbine section 18. Additionally, the gas turbine 10 may include one or more shafts 22 coupled between the compressor section 14 and the turbine section 18.

The compressor section 14 may generally include a plurality of rotor disks 24 (one of which is shown) and a plurality of rotor blades 26 extending radially outwardly from and connected to each rotor disk 24. Each rotor disk 24 in turn may be coupled to or form a portion of the shaft 22 that extends through the compressor section 14. The compressor section 14 further includes a plurality of stationary vanes (not shown), which are arranged in stages with the rotor blades 26 and which direct the flow against the rotor blades 26.

The turbine section 18 may generally include a plurality of rotor disks 28 (one of which is shown) and a plurality of rotor blades 30 extending radially outwardly from and connected to each rotor disk 28. Each rotor disk 28 in turn may be coupled to or form a portion of the shaft 22 that extends through the turbine section 18. The turbine section 18 further includes an outer casing 31 that circumferentially surrounds the turbine portion of the shaft 22 and the rotor blades 30, thereby at least partially defining a hot gas path 32 through the turbine section 18. The turbine section 18 further includes a plurality of stationary vanes (not shown), which are arranged in stages with the rotor blades 30 and which direct the flow against the rotor blades 30.

During operation, a working fluid such as air flows through the inlet section 12 and into the compressor section 14 where the air is progressively compressed by multiple compressor stages of rotating blades and stationary vanes, thus providing pressurized air 15 to the combustors 17 of the combustion section 16. The pressurized air is mixed with fuel and burned within each combustor 17 to produce combustion gases 34. The combustion gases 34 flow through the hot gas path 32 from the combustion section 16 into the turbine section 18, in which energy (kinetic and/or thermal) is transferred from the combustion gases 34 to the rotor blades 30, causing the shaft 22 to rotate. The mechanical rotational energy may then be used to power the compressor section 14 and/or to generate electricity (e.g., when the shaft 22 is coupled to a generator, not shown). The combustion gases 34 exiting the turbine section 18 may then be exhausted from the gas turbine 10 via the exhaust section 20.

Figure 2:
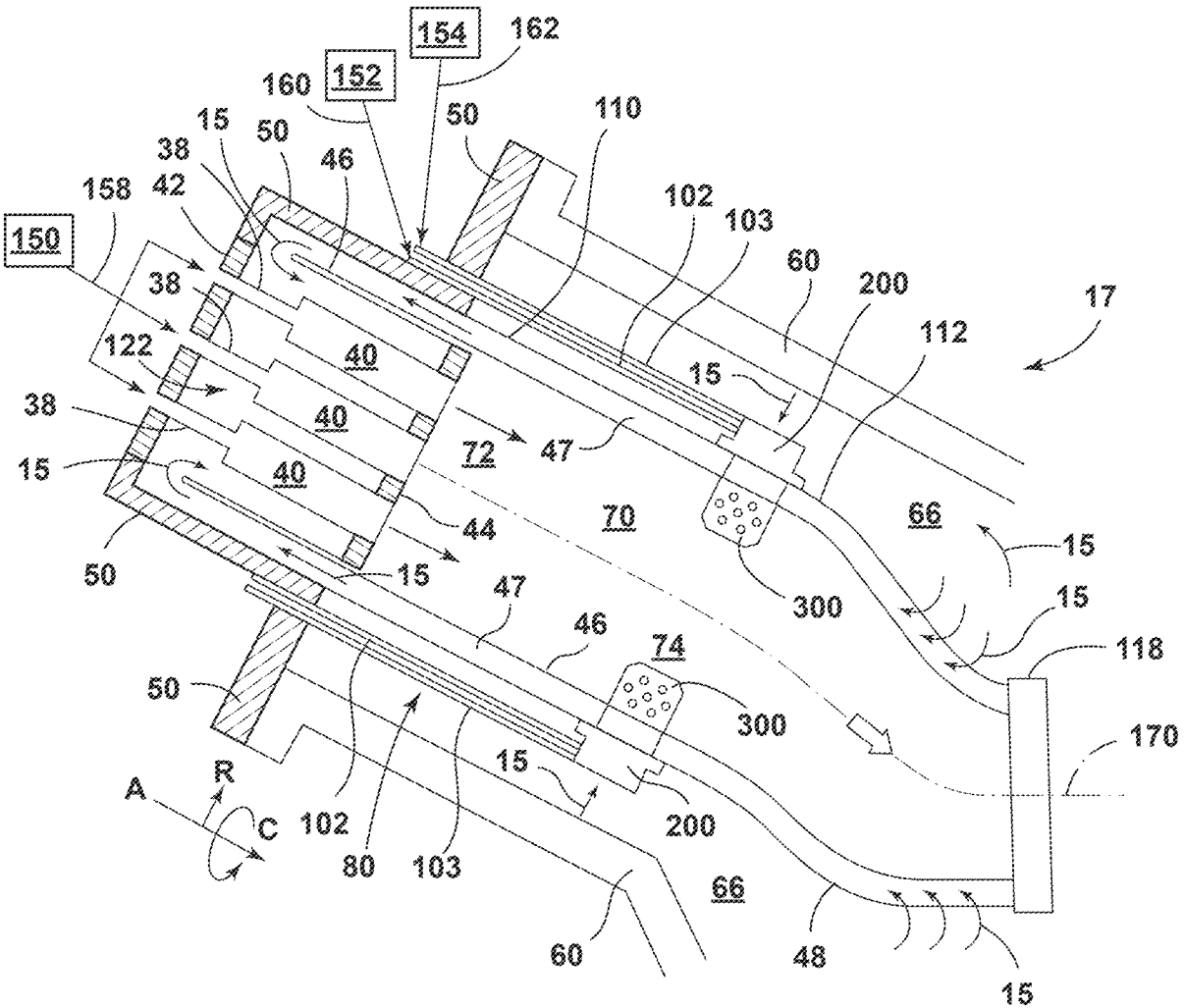
FIG. 2 illustrates a cross-sectional view of a combustor suitable for use in the turbomachine of FIG. 1, in accordance with embodiments of the present disclosure.

FIG. 2 is a schematic representation of a combustor 17, as may be included in a can annular combustion system for the gas turbine 10. In a can annular combustion system, a plurality of combustors 17 (e.g., 8, 10, 12, 14, 16, or more) are positioned in an annular array about the shaft 22 that connects the compressor section 14 to the turbine section 18.

As shown in FIG. 2, the combustor 17 may define a cylindrical coordinate system having an axial direction A that extends along an axial centerline 170. The combustor may also define a circumferential direction C which extends around the axial direction A and the axial centerline 170. The combustor 17 may further define a radial direction R perpendicular to the axial direction A and the axial centerline 170. While FIGS. 3 through 6 illustrate various views of a fuel injector 80 with reference to the cylindrical coordinate system of the combustor 17, the fuel injector 80 is not necessarily limited to use in the combustor 17 illustrated in FIG. 2, and the fuel injector 80 may be utilized in any type of combustion system having any suitable coordinate system or arrangement (e.g., an annular combustion system).

FIG. 2 illustrates a combustor 17 having one or more exemplary fuel injectors 80 (also referred to as an axial fuel staging (AFS) system), as discussed further herein. The combustor 17 includes a combustion liner 46 that defines a combustion chamber 70. The combustion liner 46 may be positioned within (i.e., circumferentially surrounded by) an outer sleeve 48, such that an annulus 47 is formed therebetween. At least one fuel nozzle 40 may be positioned at the forward end of the combustor 17. Fuel may be directed through first fuel supply conduits 38, which extend through an end cover 42, and into the fuel nozzles 40. The fuel nozzles 40 convey the fuel and compressed air 15 into a primary combustion zone 72, where combustion occurs. In some embodiments, the fuel and compressed air 15 are combined as a mixture prior to reaching the primary combustion zone 72.

The combustion liner 46 may contain and convey combustion gases to the turbine section 18. The combustion liner 46 defines the combustion chamber 70 within which combustion occurs. As shown in FIG. 2, the combustion liner 46 may extend between the fuel nozzles 40 and an aft frame 118. The combustion liner 46 may have a cylindrical liner portion and a tapered transition portion that is separate from the cylindrical liner portion, as in many conventional combustion systems. Alternately, the combustion liner 46 may have a unified body (or "unibody") construction, in which the cylindrical portion and the tapered portion are integrated with one another. Thus, any discussion of the combustion liner 46 herein is intended to encompass both conventional combustion systems having a separate liner and transition piece and those combustion systems having a unibody liner. Moreover, the present disclosure is equally applicable to those combustion systems in which the transition piece and the stage one nozzle of the turbine section 18 are integrated into a single unit, sometimes referred to as a "transition nozzle" or an "integrated exit piece."

The combustion liner 46 may be surrounded by an outer sleeve 48, which is spaced radially outward of the combustion liner 46 to define an annulus 47 through which compressed air 15 flows to a head end of the combustor 17. Heat is transferred convectively from the combustion liner 46 to the compressed air 15, thus cooling the combustion liner 46 and warming the compressed air 15.

In exemplary embodiments, the outer sleeve 48 may include a flow sleeve 110 at the forward end and an impingement sleeve 112 at the aft end. The flow sleeve 110 and the impingement sleeve 112 may be coupled to one another. Alternately, the outer sleeve 48 may have a unified body (or "unisleeve") construction, in which the flow sleeve 110 and the impingement sleeve 112 are integrated with one another in the axial direction. As before, any discussion of the outer sleeve 48 herein is intended to encompass both conventional combustion systems having a separate flow sleeve 110 and impingement sleeve 112 and combustion systems having a unisleeve outer sleeve.

The forward casing 50 and the end cover 42 of the combustor 17 define the head end air plenum 122, which includes one or more fuel nozzles 40. The fuel nozzles 40 may be any type of fuel nozzle, such as bundled tube fuel nozzles (often referred to as "micromixers") or swirler nozzles (often referred to as "swozzles"). For example, the fuel nozzles 40 are positioned within the head end air plenum 122 defined at least partially by the forward casing 50. In many embodiments, the fuel nozzles 40 may extend from the end cover 42. For example, each fuel nozzle 40 may be coupled to an aft surface of the end cover 42 via a flange (not shown). As shown in FIG. 2, the at least one fuel nozzle 40 may be partially surrounded by the combustion liner 46. The aft, or downstream ends, of the fuel nozzles 40 extend through a cap plate 44 that defines the upstream end of the combustion chamber 70.

The fuel nozzles 40 may be in fluid communication with a first fuel supply 150 configured to supply a first fuel 158 to the fuel nozzles 40. In many embodiments, the first fuel 158 may be a fuel mixture containing natural gas (such as methane, ethane, propane, or other suitable natural gas) and hydrogen. In other embodiments, the first fuel 158 may be pure natural gas or pure hydrogen (e.g., 200% hydrogen), such that the first fuel is not a mixture of multiple fuels.

In exemplary embodiments, the first fuel 158 and compressed air 15 may mix together within the fuel nozzles 40 to form a first mixture of compressed air 15 and the first fuel 158 before being ejected (or injected) by the fuel nozzles 40 into the primary combustion zone 72. The first mixture of the first fuel 158 and compressed air 15 may be injected into the primary combustion zone 72 and ignited to generate a first flow of combustion gases 164 having a first temperature.

The forward casing 50 may be connected fluidly and mechanically to a compressor discharge casing 60, which defines a high pressure plenum 66 around the combustion liner 46 and the outer sleeve 48. Compressed air 15 from the compressor section 14 travels through the high pressure plenum 66 and enters the combustor 17 via apertures (not shown) in the downstream end of the outer sleeve 48 (as indicated by arrows near the aft frame 118). Compressed air travels upstream through the annulus 47 and is turned by the end cover 42 to enter the fuel nozzles 40 and to cool the head end. In particular, compressed air 15 flows from high pressure plenum 66 into the annulus 47 at an aft end of the combustor 17, via openings defined in the outer sleeve 48. The compressed air 15 travels upstream from the aft end of the combustor 17 to the head end air plenum 122, where the compressed air 15 reverses direction and enters the fuel nozzles 40.

In the exemplary embodiment, a fuel injector 80 is provided to deliver a second fuel/air mixture and/or a third fuel/air mixture to the secondary combustion zone 74. For example, the fuel injector 80 may include a premix injector 200 and an immersed injector 300 coupled to the premix injector 200. As used herein, unless otherwise specified, the phrase "coupled to" may include both a removable coupling and a non-removable coupling (e.g., welded or integrally formed). For example, the premix injector 200 may be removably coupled to the immersed injector 300, or the premix injector 200 may be non-removably coupled to the immersed injector 300. Additionally, the premix injector 200 may be integrally formed with the immersed injector 300 (e.g., as a single component via an additive manufacturing system). The premix injector 200 may introduce a second flow of fuel and air may to the secondary combustion zone 74, and the immersed injector 300 may introduce a third flow of fuel and air to the secondary combustion zone 74.

The primary combustion zone 72 and the secondary combustion zone 74 may each be portions of the combustion chamber 70 and therefore may be defined by the combustion liner 46. For example, the primary combustion zone 72 may be defined from an outlet of the fuel nozzles 40 to the premix injector 200, and the secondary combustion zone may be defined from the premix injector 200 to the aft frame 118. In this arrangement, the forwardmost boundary of the premix injector 200 may define the end of the primary combustion zone 72 and the beginning of the secondary combustion zone 74 (e.g., at an axial location where a second flow of fuel and air are introduced).

Such a combustion system having axially separated combustion zones is described as an "axial fuel staging" (AFS) system. The fuel injectors 80 may be circumferentially spaced apart from one another on the outer sleeve 48 (e.g., equally spaced apart in some embodiments). In many embodiments, the combustor 17 may include four fuel injectors 80 spaced apart from one another and configured to inject a second mixture of fuel and air into a secondary combustion zone 74 via the premix injector 200 and configured to inject a third mixture of fuel and air via the immersed injector 300, in order to increase the combustion gases 34 and temperature thereof. In other embodiments, the combustor 17 may include any number of fuel injectors 80 (e.g., 1, 2, 3, or up to 10 or more).

As shown in FIG. 2, each fuel injector 80 may include the premix injector 200, the immersed injector 300, a second fuel supply conduit 102 that supplies a second fuel (such as pure hydrogen or a natural gas and hydrogen mixture comprising greater than 80% hydrogen) to the premix injector 200, and a third fuel supply conduit 103 that supplies a third fuel (such as pure hydrogen or a natural gas and hydrogen mixture comprising greater than 80% hydrogen) to the immersed injector 300. For example, each premix injector 200 may be in fluid communication, at least partially via the second fuel supply conduit 102, with a second fuel supply 152 configured to supply a second fuel 160 to each premix injector 200. In many embodiments, the second fuel 160 may be a fuel mixture containing natural gas (such as methane, ethane, propane, or other suitable natural gas) and hydrogen. In other embodiments, the second fuel 160 may be pure natural gas or pure hydrogen (e.g., 200% hydrogen), such that the second fuel includes no other fuels mixed therein. Similarly, each immersed injector 300 may be in fluid communication, at least partially via the third fuel supply conduit 103, with a third fuel supply 154 configured to supply a third fuel 162 to each immersed injector 300. In many embodiments, the third fuel 162 may be a fuel mixture containing natural gas (such as methane, ethane, propane, or other suitable natural gas) and hydrogen. In other embodiments, the third fuel 162 may be pure natural gas or pure hydrogen (e.g., 200% hydrogen), such that the third fuel includes no other fuels mixed therein.

Because the fuel nozzles 40, the premix injectors 200, and the supplemental immersed injectors 300 are separately fueled (e.g., via the fuel supplies 150, 152, and 154), they may allow the combustor a wide range of operational flexibility. For example, each of the fuel nozzles 40, the premix injectors 200, and the immersed injectors 300 may be supplied with a different fuel or fuel mixture. Particularly, in exemplary embodiments, each of the fuel nozzles 40, the premix injectors 200, and the immersed injectors 300 may be supplied pure hydrogen or a fuel mixture that contains mostly hydrogen (e.g., greater than 80% hydrogen) and natural gas (such as methane, ethane, propane, or other natural gas). However, it should be appreciated that, in some embodiments, some or all of the fuel nozzles 40, the premix injectors 200, and the immersed injectors 300 may be fueled by the same fuel supply, such that the same fuel mixture or pure fuel is supplied to some or all of the fuel nozzles 40, the premix injectors 200, and the immersed injectors 300.

As used herein, the term "premix" may be used to describe a component, passage, or cavity in which fuel and air are mixed together prior to being injected into the combustion chamber 70. In many embodiments, each premix injector 200 may fluidly couple the high pressure plenum 66 to the secondary combustion zone 74. For example, compressed air 15 from the high pressure plenum 66 may enter the premix injector 200 where it is mixed with the second fuel 160 prior to being injected into the secondary combustion zone 74. For example, in exemplary embodiments, each premix injector 200 may extend through the outer sleeve 48, the annulus 47, and the combustion liner 46 and direct a fuel/air mixture into the secondary combustion zone 74. Specifically, the premix injectors 200 may each extend radially from the high pressure plenum 66, through the outer sleeve 48, the annulus 47, and the combustion liner 46, such that the premix injector 200 is capable of delivering a second flow of fuel and air to the secondary combustion zone 74. The premix injectors 200 may be coupled to the combustion liner 46 and/or the outer sleeve 48, such that each premix injector 200 introduces the second fuel/air mixture as a jet entering a cross-flow of the combustion gases 164 produced in the primary combustion zone 72. The second fuel/air mixture(s) are ignited by the combustion gases 164 from the primary combustion zone 72 and burn in the secondary combustion zone 74.

The premix injector 200 may be coupled to the outer sleeve 48 and may extend through the outer sleeve 48 and the combustion liner 46. In one embodiment, a boss (not shown) supporting the premix injector 200 functions as a fastener for securing the outer sleeve 48 to the combustion liner 46. In other embodiments, the premix injector 200 may be coupled to the outer sleeve 48 in any suitable manner, and the outer sleeve 48 may have any suitable number of components coupled between the flange of the forward casing 50 and the turbine nozzle in any suitable manner that permits the fuel injector 80 to function as described herein.

The immersed injector 300 may extend radially through the premix injector 200 (e.g., through the center of the premix injector 200) and into the secondary combustion zone 74. For example, the immersed injector 300 may extend radially into the secondary combustion zone 74 of the combustion chamber 70, such that the immersed injector 300 is directly exposed to combustion gases during operation of the combustor 17. As described above, although the immersed injector 300 extends through the premix injector 200, the immersed injector 300 may be fluidly isolated from the premix injector 200. In this arrangement, the premix injector 200 and the immersed injector 300 may separately inject fuel mixed with air into the secondary combustion zone 74.

Figure 3:
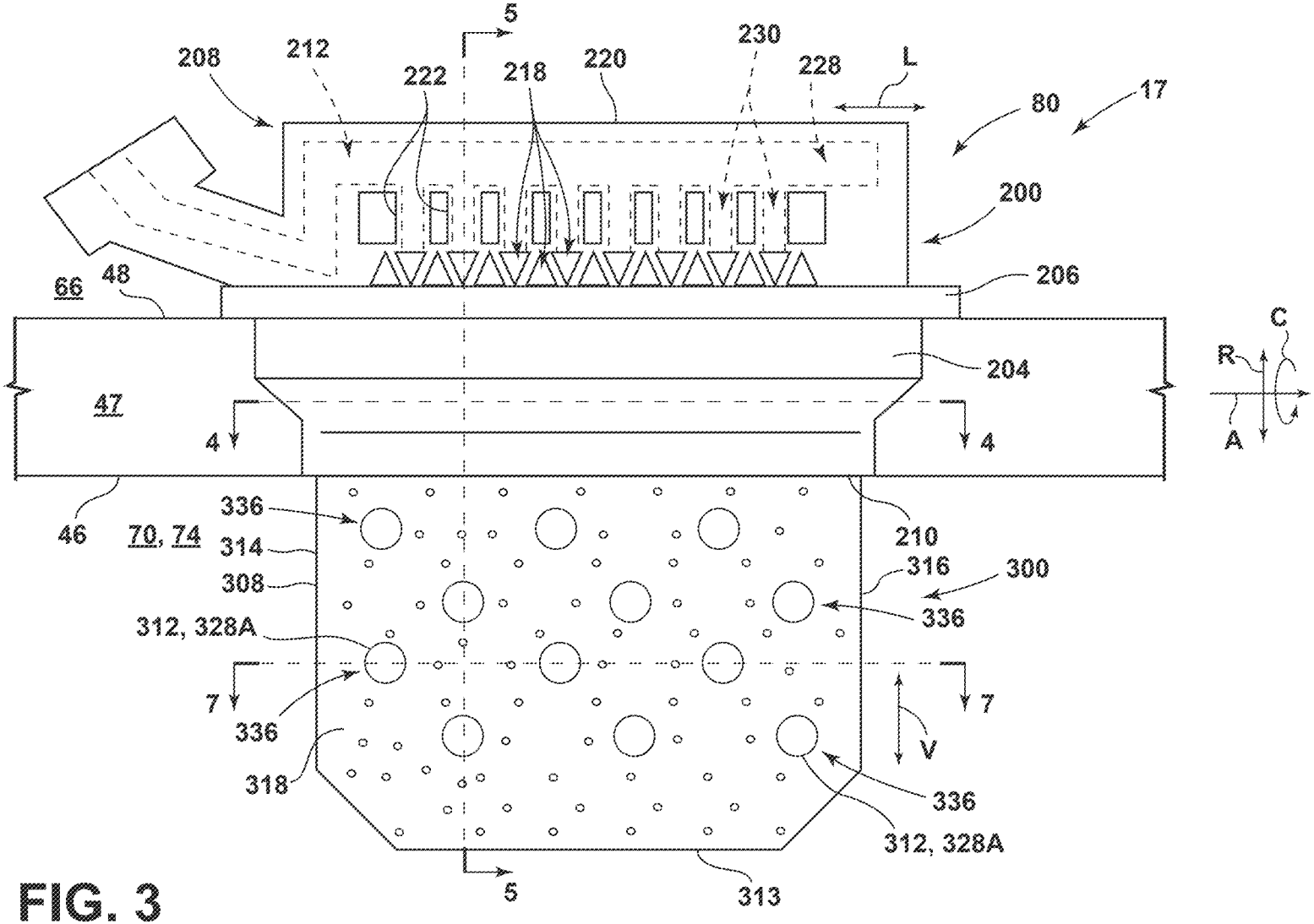
FIG. 3 is an enlarged view of a fuel injector in accordance with various aspects of the present disclosure.
Figure 4:
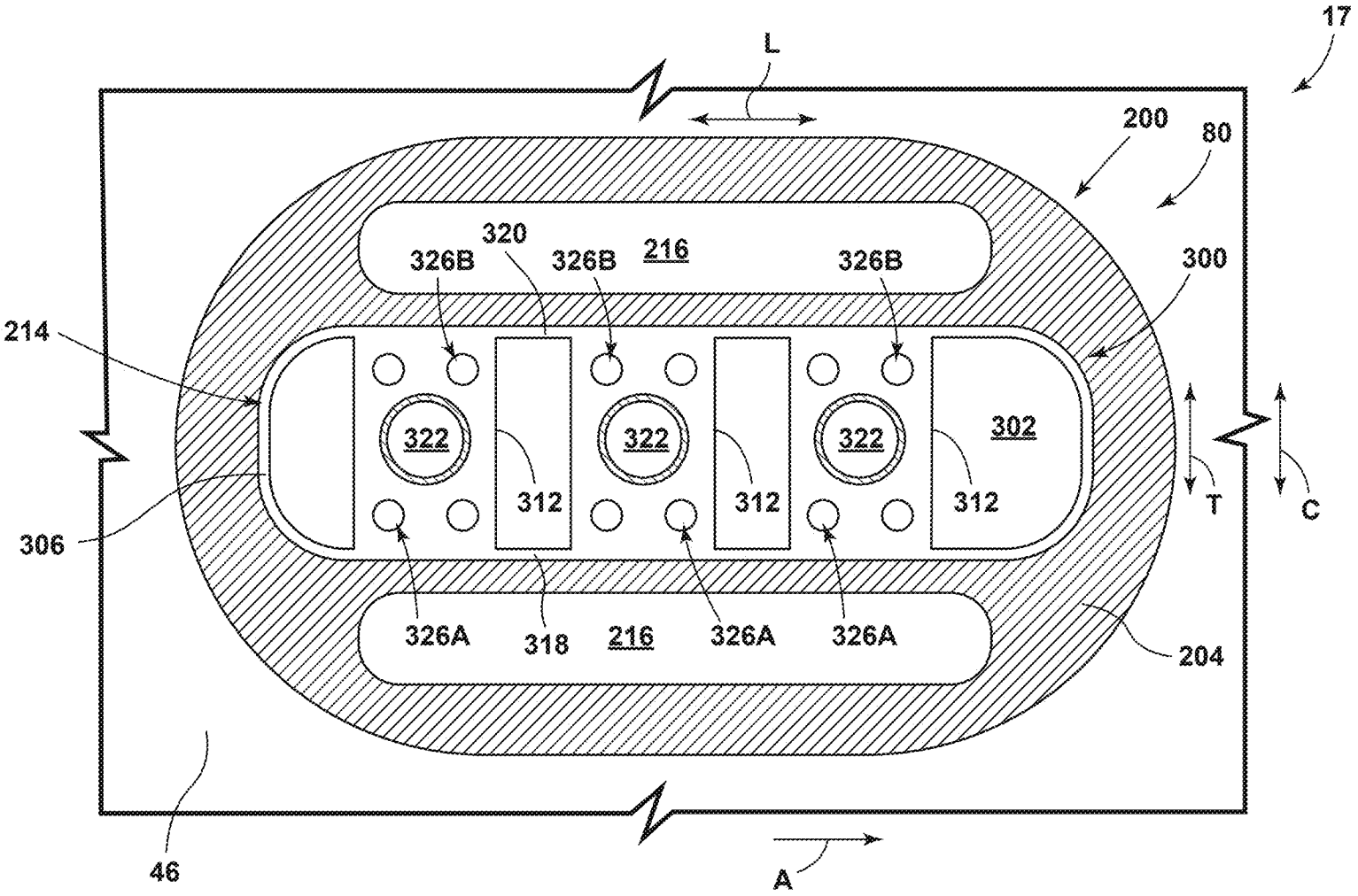
FIG. 4 is a cross-sectional view of the fuel injector shown in FIG. 3 from along the line 4-4 in accordance with embodiments of present disclosure.
Figure 5:
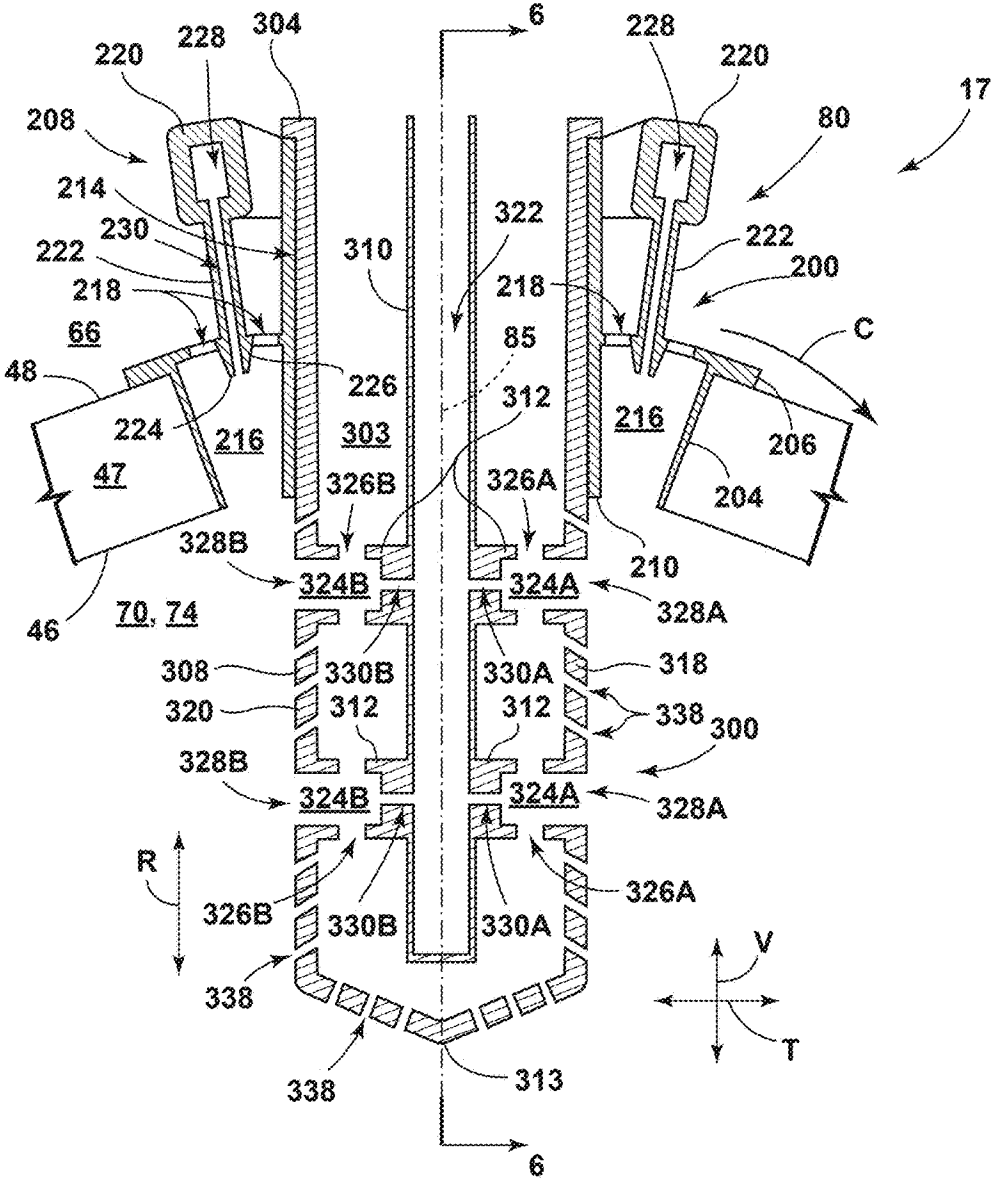
FIG. 5 is a cross-sectional view of the combustor and the fuel injector from along the line 5-5 shown in FIG. 3 in accordance with exemplary aspects of the present disclosure.
Figure 6:
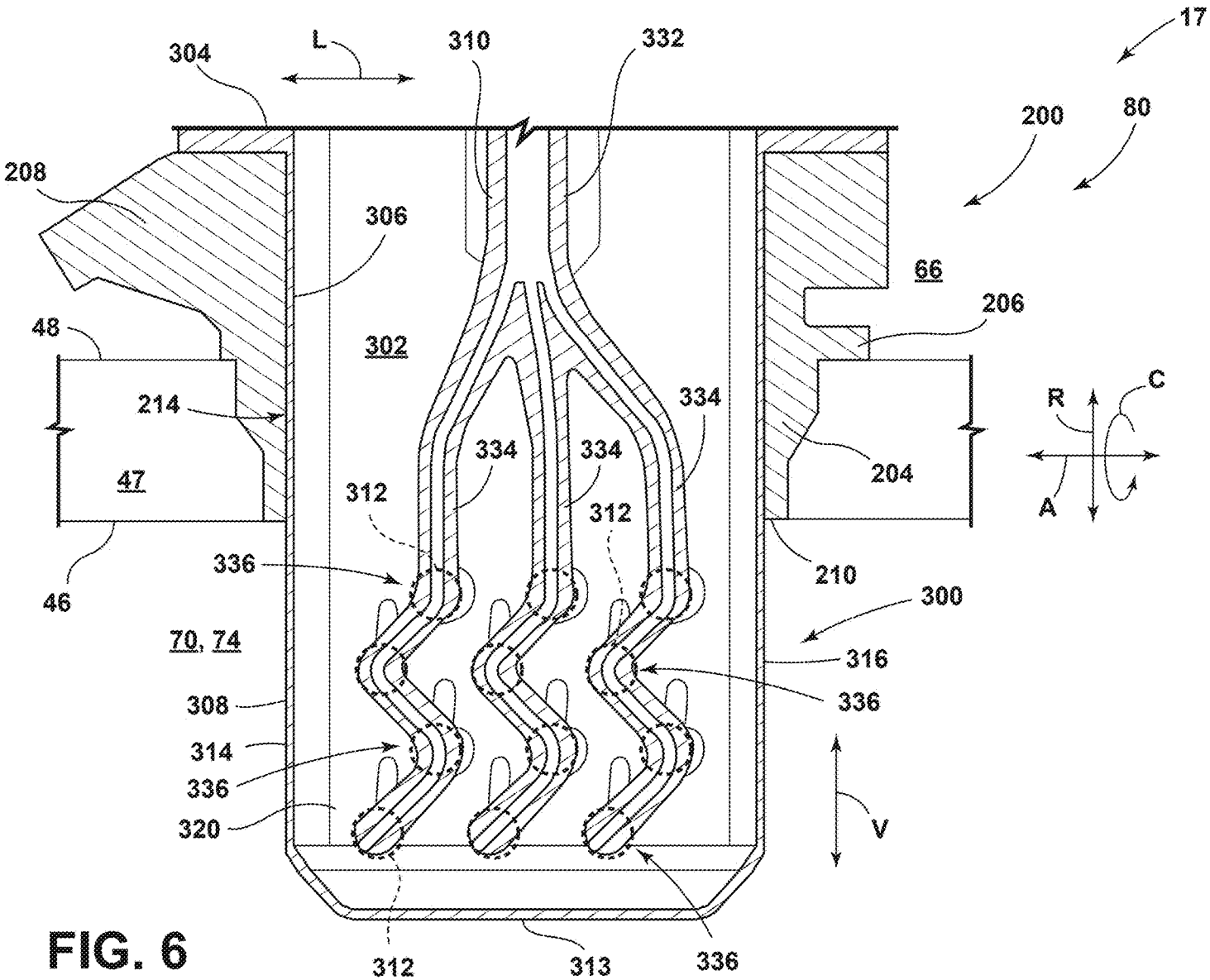
FIG. 6 is a cross-sectional view of the combustor and the fuel injector from along the line 6-6 shown in FIG. 5 in accordance with exemplary aspects of the present disclosure.

Referring now to FIGS. 3 through 6, enlarged views of a combustor 17 and/or the fuel injector 80 are illustrated in accordance with embodiments of the present disclosure. Specifically, FIG. 3 is an enlarged cross-sectional view of the combustor 17 (but not the fuel injector 80) in accordance with various aspects of the present disclosure. FIG. 4 is a cross-sectional view of the fuel injector 80 from along the line 4-4 shown in FIG. 3 in accordance with embodiments of present disclosure. FIG. 5 is a cross-sectional view of the combustor 17 and the fuel injector 80 from along the line 5-5 shown in FIG. 3 in accordance with exemplary aspects of the present disclosure. FIG. 6 is a cross-sectional view of the combustor 17 and the fuel injector 80 from along the line 6-6 shown in FIG. 5 in accordance with exemplary aspects of the present disclosure.

As shown, the fuel injector 80 may define a mutually orthogonal coordinate system having a vertical direction V, a longitudinal direction L, and a transverse direction T. Each of the vertical direction V, the longitudinal direction L, and the transverse direction T may be orthogonal (or perpendicular) to one another. When the fuel injector is installed in a combustor 17, the vertical direction V of the fuel injector 80 may be parallel to the radial direction R of the combustor 17, the longitudinal direction L may be generally parallel to the axial direction A (e.g., within about ±30° of parallel), and the transverse direction T may be tangential to the circumferential direction C. Additionally, as shown in FIG. 5, the fuel injector 80 may extend along a centerline axis 85. The vertical direction V may be parallel to the centerline axis 85, and when the fuel injector 80 is installed in a combustor 17, the centerline axis 85 may be parallel to the radial direction R.

As shown, in FIGS. 3 through 6, the combustor 17 includes the combustion liner 46 and an outer sleeve 48 radially spaced apart from the combustion liner 46 such that an annulus 47 is defined between the combustion liner 46 and the outer sleeve 48. The high pressure plenum 66 may be defined radially outwardly of the outer sleeve 48, and the combustion chamber 70 may be defined radially inwardly of the combustion liner 46. The injector 80 may extend from the high pressure plenum 66, through the outer sleeve 48, through the annulus 47, through the combustion liner 46, and into the combustion chamber 70.

In exemplary embodiments, as shown in FIGS. 3 and 6, the premix injector 200 may include a main body portion 204, a flange portion 206, and a fuel supply portion 208. The flange portion 206 may extend outwardly from the main body 204 (e.g., longitudinally and transversely with respect to the coordinate system of the fuel injector 80 and/or axially and circumferentially with respect to the coordinate system of the combustor 17). The flange portion 206 may be positioned between (e.g., vertically between and/or radially between) the main body portion 204 and the fuel supply portion 208. The main body portion 204 may extend inward (e.g., vertically inward and/or radially inward) from the flange portion 206 to an inner end 210. The premix injector 200 may terminate (vertically and/or radially) at the inner end 210, which may contact an outer surface of the combustion liner 46 (or may be exposed to the combustion gases in some embodiments). In this way, the premix injector 200 may not extend beyond (e.g., radially) the combustion liner 46 and into the combustion chamber 46. By contrast, the immersed injector 300 does extend radially beyond the combustion liner 46 and into the combustion chamber 70.

The fuel supply portion 208 may extend outwardly from the flange portion 206 (e.g., vertically with respect to the coordinate system of the fuel injector 80 and/or radially with respect to the coordinate system of the combustor 17). The flange portion 206 may couple the premix injector 200 to the outer sleeve 48 (e.g., via one or more fasteners). For example, one or more fasteners may extend through the flange portion 206 and the outer sleeve 48 to connect the premix injector 200 to the outer sleeve 48. The fuel supply portion 208 may define a fuel supply circuit 212 (shown in phantom in FIG. 3).

As shown in FIGS. 4 and 5, the premix injector 200 may define a main opening 214 and one or more premix passages 216. The immersed injector 300 may be positioned at least partially in the main opening 214. That is, the immersed injector 300 may extend (e.g., radially) through the main opening 214 and into the combustion chamber 70 (as shown in FIG. 5). The main opening 214 may be positioned on, and extends along, the centerline axis 85 of the fuel injector 80 (FIG. 5). In many embodiments, as shown in FIG. 4, the premix injector 200 may define two premixing slots 216 on either side of the main opening 214 (e.g., with respect to the transverse direction). Specifically, the premixing injector 200 may define a first premixing slot 216 on a first side of the main opening 214 and a second premixing slot 216 on a second side of the main opening 214. In other words, the premixing slots 216 may be spaced apart from one another (e.g., in the transverse direction T) such that the main opening 214 is disposed between the premixing slots 216.

As shown, the main opening 214 and the one or more premixing slots 216 may be longer in the longitudinal direction L than in the transverse direction T. When the fuel injector 80 is installed in a combustor 17, longitudinal direction L of the fuel injector 80 may be generally parallel to the axial direction A of the combustor 17 (e.g., within about ±30° of parallel). In this way, the fuel injector 80 may advantageously introduce a large amount of fuel and/or air into the secondary combustion zone 74 (e.g., via the immersed injector 300 and the premixing slots 216) without having the premix injector 200 impede a large portion of the annulus 47 through which it extends. In other embodiments, the main opening 214 and/or the premixing slots 216 may have a variety of cross-sectional shapes, such as but not limited to a rectangle, oval, stadium shape (e.g., a rectangle having arced or curved ends), or other suitable shapes.

As shown in FIGS. 3 and 5, the fuel supply portion 208 (e.g., via the fuel supply circuit 212) may supply fuel to the one or more premixing slots 216. Additionally, the premix injector 200 may define one or more air apertures 218 for providing air to the one or more premixing slots 216. As shown in FIG. 3, the air apertures may be generally triangularly shaped, but other shapes are possible (such as a circle, an oval, a polygon, or others). The air apertures 218 may fluidly connect the high pressure plenum 66 and the one or more premixing slots 216, such that the one or more premixing slots 216 receives air from the high pressure plenum 66 via the air apertures 218.

Still referring to FIGS. 3 and 5, the fuel supply portion 208 may include a fuel manifold 220, and a plurality of fuel supply tubes 222 extending from the fuel manifold 220 and into one of the one or more premixing slots 216 (FIG. 5). The fuel supply tubes 222 may be spaced apart from one another, e.g., longitudinally spaced apart with respect to the coordinate system of the fuel injector 80 and/or axially spaced apart with respect to the coordinate system of the combustor 17 (FIG. 3). Additionally, one or more of the fuel supply tubes 222 may partially define the one or more air apertures 218. As shown in FIG. 5, each fuel supply tube 222 of the plurality of fuel supply tubes 222 may extend to a tube end 224. As shown in FIG. 5, each fuel supply tube 222 of the plurality of fuel supply tubes 222 includes a conically shaped portion 226 extending to the tube end. The conically shaped portion 226 tapers or converges in diameter as the conically shaped portion 226 extends to the tube end 224. The conically shaped portion 226 at least partially defines the one or more air apertures 218. As shown in FIGS. 3 (in phantom) and 5, the fuel supply circuit 212 may include a common fuel plenum 228 defined in the fuel manifold 220, and each of the fuel supply tubes 222 may define fuel passage 230 that extends from the common fuel plenum 228 to a fuel outlet at the tube end 224.

As shown in FIG. 5, the one or more premix passages 216 may receive air from the high pressure plenum 66 via the air apertures 218 and fuel from the fuel outlet at the tube end 224. The air and the fuel may mix together in the one or more premix passages 216 to generate premixed air/fuel, which may be provided to the combustion chamber 70.

As shown in FIGS. 3-5, the immersed injector 300 may define an air chamber 302. Additionally, the immersed injector 300 may include a flange 304, a main body 306, an immersed body 308, a fuel supply conduit 310, and a compact premixing body 312 (e.g., a plurality of compact premixing bodies 312 in exemplary embodiments). As shown in FIG. 5, the flange 304 may be positioned at (and in contact with) a radially outermost surface of the premix injector 200. The main body 306 may extend vertically (or radially with respect to the combustor 17) from the flange 304 to the immersed body 306, and the main body 306 may be positioned (e.g., entirely) in the main opening 214 of the premix injector 200. That is, the main body 306 of the immersed injector 300 may extend through the main opening 214 of the premix injector 200. The immersed body 308 may extend vertically (or radially with respect to the combustor 17) from the main body 306 to a tip 313. When installed in a combustor 17, the immersed body 308 may be positioned in the combustion chamber 70 (such that the immersed body 308 of the immersed injector 300 is directly exposed to combustion gases).

Figure 7:
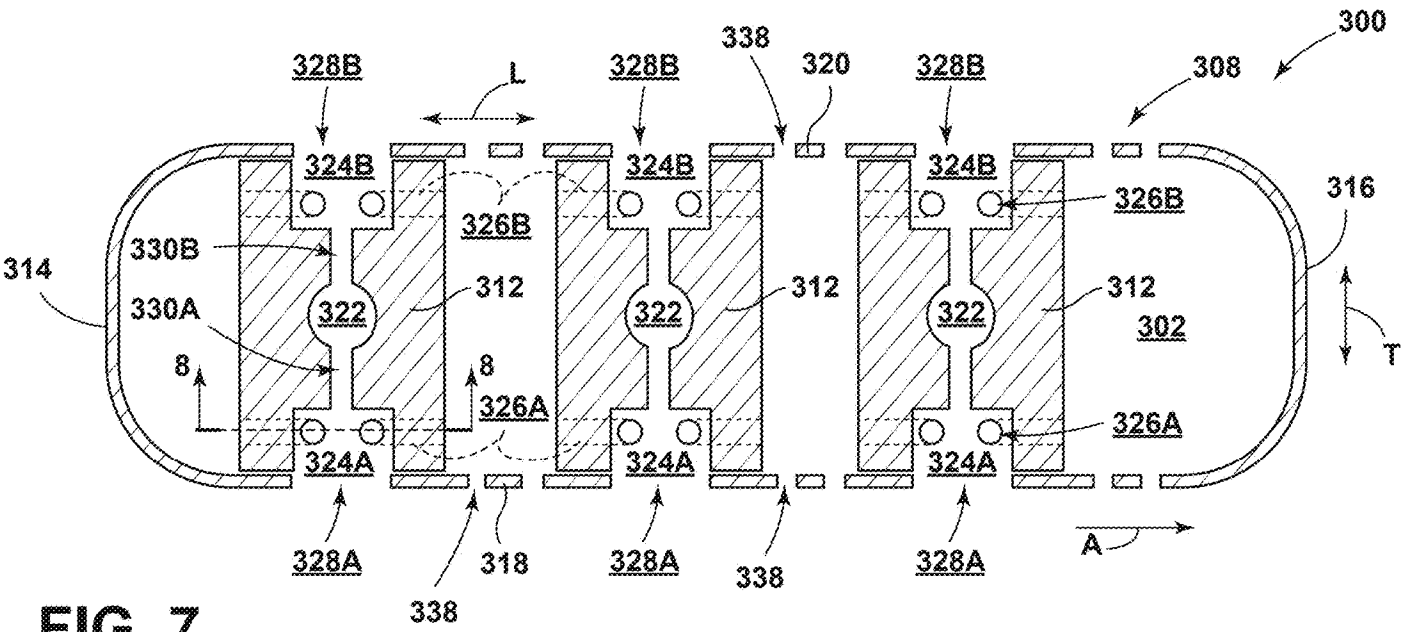
FIG. 7 illustrates a cross-sectional view of the immersed injector from along the line 7-7 shown in FIG. 4 in accordance with exemplary aspects of the present disclosure.
Figure 8:
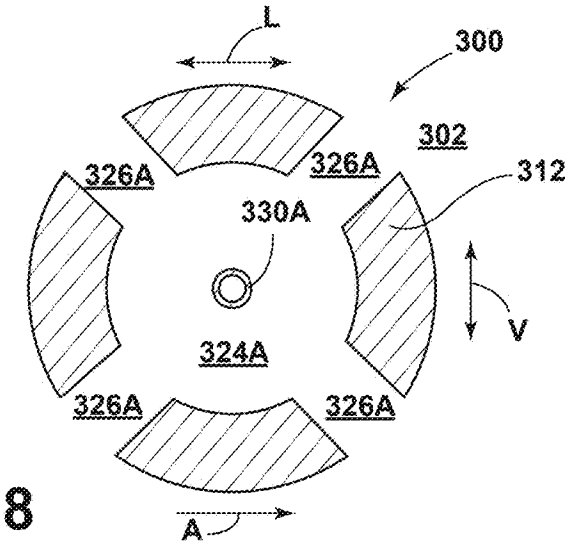
FIG. 8 illustrates a cross-sectional view of the compact premixing body shown in FIG. 7 from along the line 8-8 in accordance with exemplary aspects of the present disclosure.

FIG. 7 illustrates a cross-sectional view of the immersed injector 300 from along the line 7-7 shown in FIG. 4, and FIG. 8 illustrates a cross-sectional view of the compact premixing body 312 from along the line 8-8 shown in FIG. 7. As shown in FIGS. 3-7, the immersed body 308 may have a generally contoured aerodynamic shape in order to minimize disruption to flow of the combustion gases around the immersed injector 300 during operation of the combustor 17. Specifically, the immersed injector immersed body 308 may include a leading edge 314, a trailing edge 316, a first side wall 318, and a second side wall 320. The first side wall 318 and the second side wall 320 may be spaced apart (e.g., transversely) from one another, and the first side wall 318 and the second side wall 320 may be generally parallel to one another. The first side wall 318 and the second side wall 320 may extend between the leading edge 314 and the trailing edge 316. During operation of the immersed injector 300, the combustion gases may engage the immersed body 308 at the leading edge 314 and may travel along the side walls 318, 320 to the trailing edge 316.

Additionally, as shown, the fuel supply conduit 310 and the plurality of compact premixing bodies 312 may be positioned in the air chamber 302. The plurality of premixing bodies 312 may be positioned in the immersed body 308 and may be connected to (or integral with) the immersed body 308. The fuel supply conduit 310 may define a fuel supply passage 322, and each of the compact premixing bodies 312 may define one or more compact premixing chambers 324A, 324B. The compact premixing chambers 324A, 324B may be fluidly connected to each of the air chamber 302, the combustion chamber 70, and the fuel supply passage 322.

That is, the compact premixing chambers 324A, 324B may receive air from the air chamber 302 via a plurality of air apertures 326A, 326B. That is, the compact premixing body 312 defines the plurality of air apertures 326A, 326B that fluidly couple the compact premix chambers 324A, 324B and the air chamber 302. Additionally, the compact premixing chambers 324A, 324B may receive fuel from the fuel passage 322 via fuel channels 330A, 330B. That is, the compact premixing body 312 defines the fuel channels 330A, 330B that each extend from the fuel supply passage to a respective compact premix chamber 324A, 324B. The air and fuel may mix together in the compact premixing chambers 324A, 324B and be provided to the combustion chamber 70 via outlets 328A, 328B.

Each compact premixing body 312 may extend between the fuel supply conduit 310 and the immersed body 308. In many embodiments, one or more of the compact premixing bodies 312 may extend between the fuel supply conduit 310 and at least one of the first side wall 318 and the second side wall 320. Specifically, as shown in FIGS. 4, 5, and 7, each of the compact premixing bodies may extend between the first side wall 318 and the second side wall 320. That is, each compact premixing body 312 may extend from the fuel supply conduit 310 to both of the first side wall 318 and the second side wall 320.

The compact premix chambers 324A, 324B may each extend to a respective outlet on one of the first side wall 318 or the second side wall 320. Specifically, each compact premixing body 312 may define a first compact premix chamber 324A extending to a first outlet 328A at the first side wall 318 and a second compact premix chamber 324B extending to a second outlet 328B at the second side wall 320. The compact premixing bodies 312 may be generally cylindrically shaped and may define a centerline axis that is generally parallel to the transverse direction T.

In many embodiments, each compact premixing body 312 defines a plurality of first air apertures 326A and a plurality of second air apertures 326B. The plurality of first air apertures 326A may fluidly connect the air chamber 302 and the first compact premix chamber 324A, and the plurality of second air apertures 326B that may fluidly connect the air chamber 302 and the second premix chamber 324B. As shown in FIG. 8, the plurality of first air apertures 326A may be oriented at an angle relative to the vertical direction and the longitudinal direction L. That is, each of the first air apertures 326A may extend along a center axis that is angled (e.g., at an oblique angle) relative to the vertical direction V and the longitudinal direction L, which advantageously improves mixing. The plurality of second air apertures 326B may be oriented similarly as the plurality of first air apertures 326A shown in FIG. 8.

As shown in FIG. 6, the fuel supply conduit may include a main portion 332 and a plurality of branches 334 extending from the main portion 332. Each branch 334 of the plurality of branches may be connected to a group of compact premixing bodies 312 (shown in phantom in FIG. 6) of the plurality of compact premixing bodies 312. Additionally, as shown in FIGS. 3 and 6, the plurality of compact premixing bodies 312 may be arranged in a plurality of longitudinal rows 336 that are vertically separated. The compact premixing bodies 312 may be staggered such that each compact premixing body 312 in each longitudinal row 336 is longitudinally offset from a compact premixing body 312 in a neighboring longitudinal row 336.

Each branch 334 of the plurality of branches may extend vertically through (and fluidly connect to) a compact premixing body 312 in each longitudinal row 336 of the plurality of longitudinal rows 336 such that each branch 334 includes a serpentine curvature (e.g., an S-like or sine-like oscillating curvature). That is, each branch 334 of the plurality of branches may include a smooth curvature that undulates back and forth between a peak and a trough. A compact premixing body 312 may be positioned at each peak and trough of the serpentine curvature of the branch 334.

In many embodiments, as shown in FIGS. 3, 5, and 7, the immersed body 308 may define a plurality of film cooling holes 338 that are in fluid communication with the air chamber 302. Particularly, the plurality of film cooling holes 338 may fluidly connect the air chamber 302 and the combustion chamber 70. As shown in FIG. 5, the film cooling holes 338 may be angled relative to the vertical direction, which may advantageously increase the film cooling effectiveness on an exterior surface of the immersed body 308.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

A fuel injector defining a mutually orthogonal coordinate system including a vertical direction, a longitudinal direction, and a transverse direction, the fuel injector comprising: a premix injector defining one or more premix passages, the premix injector including a fuel supply portion for providing fuel to the one or more premix passages and defining one or more air apertures for providing air to the one or more premix passages; and an immersed injector coupled to the premix injector, the immersed injector defining an air chamber and including: an immersed body; a fuel supply conduit defining a fuel supply passage; and a compact premixing body extending between the fuel supply conduit and the immersed body, wherein the compact premixing body defines one or more compact premixing chambers fluidly connected to the fuel supply passage and the air chamber.

The fuel injector as in any preceding clause, wherein the fuel supply portion defines a fuel supply circuit, wherein the fuel supply portion includes a fuel manifold and a plurality of fuel supply tubes extending from the fuel manifold into one of the one or more premix passages.

The fuel injector as in any preceding clause, wherein the immersed injector includes a main body extending through the premix injector, and wherein the immersed body extends from the main body to a tip.

The fuel injector as in any preceding clause, wherein the compact premixing body defines a fuel channel extending from the fuel supply passage to the compact premix chamber.

The fuel injector as in any preceding clause, wherein the compact premixing body defines a plurality of air apertures that fluidly couple the compact premix chamber and the air chamber.

The fuel injector as in any preceding clause, wherein the immersed body includes a leading edge, a trailing edge, a first side wall, and a second side wall, wherein the first side wall and the second side wall extend between the leading edge and the trailing edge, and wherein the compact premixing body extends between the fuel supply conduit and at least one of the first side wall and the second side wall.

The fuel injector as in any preceding clause, wherein the compact premix chamber extends to an outlet at one of the first side wall or the second side wall.

The fuel injector as in any preceding clause, wherein the fuel injector defines a plurality of compact premixing bodies each defining a respective compact premix chamber that extends to a respective outlet defined in one of the first side wall and the second side wall.

The fuel injector as in any preceding clause, wherein the fuel supply conduit includes a plurality of branches each connected to a group of compact premixing bodies of the plurality of compact premixing bodies.

The fuel injector as in any preceding clause, wherein the plurality of compact premixing bodies are arranged in a plurality of longitudinal rows that are vertically separated, and wherein the compact premixing bodies are staggered such that each compact premixing body in each longitudinal row is longitudinally offset from a compact premixing body in a neighboring longitudinal row.

The fuel injector as in any preceding clause, wherein the immersed body defines a plurality of film cooling holes in fluid communication with the air chamber.

A combustor comprising: a combustion liner defining a combustion chamber; a fuel injector defining a mutually orthogonal coordinate system that includes a longitudinal direction, a transverse direction, and a vertical direction, the fuel injector comprising: a premix injector defining one or more premix passages fluidly connected to the combustion chamber, the premix injector including a fuel supply portion for providing fuel to the one or more premix passages and defining one or more air apertures for providing air to the one or more premix passages; and an immersed injector coupled to the premix injector, the immersed injector defining an air chamber and including: an immersed body; a fuel supply conduit defining a fuel supply passage; and a compact premixing body extending between the fuel supply conduit and the immersed body, wherein the compact premixing body defines one or more compact premixing chambers fluidly connected to the fuel supply passage, the air chamber, and the combustion chamber.

The combustor as in any preceding clause, wherein the fuel supply portion defines a fuel supply circuit, wherein the fuel supply portion includes a fuel manifold and a plurality of fuel supply tubes extending from the fuel manifold into one of the one or more premix passages.

The combustor as in any preceding clause, wherein the immersed injector includes a main body extending through the premix injector, and wherein the immersed body extends from the main body to a tip.

The combustor as in any preceding clause, wherein the compact premixing body defines a fuel channel extending from the fuel supply passage to the compact premix chamber.

The fuel injector as in any preceding clause, wherein the compact premixing body defines a plurality of air apertures that fluidly couple the compact premix chamber and the air chamber.

The combustor as in any preceding clause, wherein the immersed body includes a leading edge, a trailing edge, a first side wall, and a second side wall, wherein the first side wall and the second side wall extend between the leading edge and the trailing edge, and wherein the compact premixing body extends between the fuel supply conduit and at least one of the first side wall and the second side wall.

The combustor as in any preceding clause, wherein the compact premix chamber extends to an outlet at one of the first side wall or the second side wall.

The combustor as in any preceding clause, wherein the fuel injector defines a plurality of compact premixing bodies each defining a respective compact premix chamber that extends to a respective outlet defined in one of the first side wall and the second side wall.

An immersed injector defines an air chamber and comprises: an immersed body; a fuel supply conduit defining a fuel supply passage; and a compact premixing body extending between the fuel supply conduit and the immersed body, wherein the compact premixing body defines one or more compact premixing chambers fluidly connected to the fuel supply passage and the air chamber.

What is claimed is:

1. A fuel injector defining a mutually orthogonal coordinate system including a vertical direction, a longitudinal direction, and a transverse direction, the fuel injector comprising:

a premix injector defining one or more premix passages, the premix injector including a fuel supply portion for providing fuel to the one or more premix passages and defining one or more air apertures for providing air to the one or more premix passages; and an immersed injector coupled to the premix injector, the immersed injector defining an air chamber and including:

an immersed body having a leading edge, a trailing edge, a first side wall, and a second side wall;

a fuel supply conduit defining a fuel supply passage; and a compact premixing body extending between the fuel supply conduit and the immersed body, wherein the compact premixing body defines one or more compact premixing chambers fluidly connected to the fuel supply passage and the air chamber, wherein at least one compact premixing chamber extends to an outlet at one of the first side wall or the second side wall.

2. The fuel injector as in claim 1, wherein the fuel supply portion defines a fuel supply circuit, wherein the fuel supply portion includes a fuel manifold and a plurality of fuel supply tubes extending from the fuel manifold into one of the one or more premix passages.

3. The fuel injector as in claim 1, wherein the immersed injector includes a main body extending through the premix injector, and wherein the immersed body extends from the main body to a tip.

4. The fuel injector as in claim 1, wherein the compact premixing body defines a fuel channel extending from the fuel supply passage to the compact premix chamber.

5. The fuel injector as in claim 1, wherein the compact premixing body defines a plurality of air apertures that fluidly couple the compact premix chamber and the air chamber.

6. The fuel injector as in claim 1, wherein the first side wall and the second side wall extend between the leading edge and the trailing edge, and wherein the compact premixing body extends between the fuel supply conduit and at least one of the first side wall and the second side wall.

7. The fuel injector as in claim 6, wherein the fuel injector defines a plurality of compact premixing bodies each defining a respective compact premix chamber that extends to a respective outlet defined in one of the first side wall and the second side wall.

8. The fuel injector as in claim 7, wherein the fuel supply conduit includes a plurality of branches each connected to a group of compact premixing bodies of the plurality of compact premixing bodies.

9. The fuel injector as in claim 8, wherein the plurality of compact premixing bodies are arranged in a plurality of longitudinal rows that are vertically separated, and wherein the compact premixing bodies are staggered such that each compact premixing body in each longitudinal row is longitudinally offset from a compact premixing body in a neighboring longitudinal row.

10. The fuel injector as in claim 1, wherein the immersed body defines a plurality of film cooling holes in fluid communication with the air chamber.

11. A combustor comprising:

a combustion liner defining a combustion chamber;

a fuel injector defining a mutually orthogonal coordinate system that includes a longitudinal direction, a transverse direction, and a vertical direction, the fuel injector comprising:

a premix injector defining one or more premix passages fluidly connected to the combustion chamber, the premix injector including a fuel supply portion for providing fuel to the one or more premix passages and defining one or more air apertures for providing air to the one or more premix passages; and an immersed injector coupled to the premix injector and extending into the combustion chamber, the immersed injector defining an air chamber and including:

an immersed body having a leading edge, a trailing edge, a first side wall, and a second side wall;

a fuel supply conduit defining a fuel supply passage; and a compact premixing body extending between the fuel supply conduit and the immersed body, wherein the compact premixing body defines one or more compact premixing chambers fluidly connected to the fuel supply passage, the air chamber, and the combustion chamber, wherein at least one compact premixing chamber extends to an outlet at one of the first side wall or the second side wall.

12. The combustor as in claim 11, wherein the fuel supply portion defines a fuel supply circuit, wherein the fuel supply portion includes a fuel manifold and a plurality of fuel supply tubes extending from the fuel manifold into one of the one or more premix passages.

13. The combustor as in claim 11, wherein the immersed injector includes a main body extending through the premix injector, and wherein the immersed body extends from the main body to a tip.

14. The combustor as in claim 11, wherein the compact premixing body defines a fuel channel extending from the fuel supply passage to the compact premix chamber.

15. The fuel injector as in claim 1, wherein the compact premixing body defines a plurality of air apertures that fluidly couple the compact premix chamber and the air chamber.

16. The combustor as in claim 11, wherein the first side wall and the second side wall extend between the leading edge and the trailing edge, and wherein the compact premixing body extends between the fuel supply conduit and at least one of the first side wall and the second side wall.

17. The combustor as in claim 16, wherein the fuel injector defines a plurality of compact premixing bodies each defining a respective compact premix chamber that extends to a respective outlet defined in one of the first side wall and the second side wall.

18. An immersed injector comprises:

an immersed body defining an air chamber, the immersed body having a leading edge, a trailing edge, a first side wall, and a second side wall;

a fuel supply conduit defining a fuel supply passage; and a compact premixing body extending between the fuel supply conduit and the immersed body, wherein the compact premixing body defines one or more compact premixing chambers fluidly connected to the fuel supply passage and the air chamber, wherein at least one compact premixing chamber extends to an outlet at one of the first side wall or the second side wall.

* * * * *